US006210134B1

(12) United States Patent
Miyahara

(10) Patent No.: US 6,210,134 B1
(45) Date of Patent: Apr. 3, 2001

(54) COOLING DEVICE AND COOLING-FAN-MOTOR THEREOF FOR ELECTRONIC APPARATUSES

(75) Inventor: Masaharu Miyahara, Oita (JP)

(73) Assignee: Matsushita Electric Industrial Co., LTD, Osaka (JP)

( * ) Notice: Subject to any disclaimer, the term of this patent is extended or adjusted under 35 U.S.C. 154(b) by 0 days.

(21) Appl. No.: 09/229,312

(22) Filed: Jan. 13, 1999

(30) Foreign Application Priority Data

Jan. 22, 1998 (JP) ..... 10-010207

(51) Int. Cl.[7] ..... F04B 17/00
(52) U.S. Cl. ..... 417/423.14; 361/697; 165/80.3
(58) Field of Search ..... 417/423.14; 361/697, 361/695, 694; 165/122, 80.3; 174/16.3; 416/176, 177, 198 R, 201 A; 415/72, 177, 178, 180

(56) References Cited

U.S. PATENT DOCUMENTS

| | | | | |
|---|---|---|---|---|
| 3,149,666 | * | 9/1964 | Coe | 165/122 X |
| 5,382,092 | * | 1/1995 | Okamoto et al. | 416/177 X |
| 5,445,215 | * | 8/1995 | Herbert | 165/80.3 |
| 5,917,699 | * | 6/1999 | Hung et al. | 361/697 |
| 6,031,721 | * | 2/2000 | Bhatia | 361/695 |
| 6,075,698 | * | 6/2000 | Hogan et al. | 361/695 |

FOREIGN PATENT DOCUMENTS

| | | |
|---|---|---|
| 7-111302 | 4/1995 | (JP) . |
| 8-274481 | 10/1996 | (JP) . |

* cited by examiner

*Primary Examiner*—Timothy S. Thorpe
*Assistant Examiner*—David J. Torrente
(74) *Attorney, Agent, or Firm*—Wenderoth, Lind & Ponack, L.L.P.

(57) ABSTRACT

In an electronic apparatus having a housing and a cooling device for cooling at least one section of heat-generating sections in the housing, the cooling device of the present invention has air-discharge-openings provided on the housing and a cooling fan motor that is thermally coupled with at least one part of the heat-generating section. The cooling fan motor of the present invention has a motor section including a rotary shaft, blades mounted on the shaft and a case, wherein the motor section is disposed at one end of the case and an opening is provided at the other end of the case. The case is made of heat conductive material, and is placed so that the openings face the air discharge openings. This structure effectively and sufficiently dissipates the build-up heat produced by the heat-generating components in the housing, and cools them down. As a result, the cooling device and the cooling fan motor of the present invention contributes to slimming electronic apparatuses such as mobile personal computers, digital video cameras and the like that require cooling devices, without degrading the cooling effect or decreasing a components-mounting-area.

11 Claims, 10 Drawing Sheets

COOLING DEVICE AND COOLING-FAN-MOTOR THEREOF FOR ELECTRONIC APPARATUSES

FIELD OF THE INVENTION

The present invention relates to cooling devices and the cooling-fan-motors thereof employed in electronic apparatuses having slim bodies.

BACKGROUND OF THE INVENTION

In the conventional slim electronic apparatus as shown in FIG. 8, printed wired assembly substrates 3 (hereinafter referred to as PWAs) are placed. On the PWAs, heat generating components 2 such as semiconductors and a CPU are mounted. The heat generated from components 2 travels through heat conductive member 6 such as an aluminum plate, and is discharged outside the apparatus. The discharged heat amount is calculated with the following expression.

$$Q\ out\quad \Sigma(Tsi-Ta)\times Si$$

where:

Q out=discharged heat amount

Tsi=a temperature at an "i" th cell of the housing surface, which is finely divided into cells Si=an area of the "i" th cell Ta=outer temperature Accordingly, the housing temperature rises and an area of high temperature increases as greater built-up heat amounts are produced by the components.

When this structure is employed in an electronic apparatus such as a mobile computer or a digital video camera, the interior built-up heat could potentially damage its internal electronic operating components. Further, since these apparatus are held by a user's hand during operation, the temperature rise on the housing surface makes the user uncomfortable. Therefore, it has been proposed to discharge the interior built-up heat forcibly outside the apparatus by providing a cooling fan in the apparatus.

In the prior art depicted in FIGS. 9A and 9B, components 2 that generate heat, such as semiconductors, are mounted on a PWA 3 that is installed in housing 1. On one of inside faces of housing 1, cooling fan 5 is provided. The height of fan 5 is substantially equal to that of a housing 1 and frame 4 of fan 5 functions as a heat sink. The heat produced by components 2 travels to fan 5 via heat conductive member 6 made of e.g. aluminum. Then fan 5 drives blades 7 to forcibly discharge the heat outside the apparatus.

FIG. 10 is a cross section of an essential part of another electronic apparatus with a conventional cooling fan. In FIG. 10, a plurality of PWAs accommodating heat generating components 2 such as semiconductors are installed in the housing 1. PWA 3 installed at the lowest place in housing 1 is shortened at its end in order to provide a space between PWA 3 and a side of the housing. In this space, flat cooling fan 8 is disposed so that its shortest side extends in the height direction of the apparatus. The frame of fan 8 functions as a heat sink. The heat produced by components 2 travels to fan 8 via heat conductive member 6 made of e.g. aluminum. Then fan 8 forcibly discharges the heat outside the apparatus. The structure in FIG. 10 mentioned above is employed in a large number of slim notebook-type personal computers. In addition to ensuring reliability of the personal computers, it is desirable that the height of cooling fan 8 be as low as ca. 7.5 mm so that the total housing height of the apparatus should be less than 20 mm.

The structure in FIG. 9 is compared with that in FIG. 10 to find the following fact. The structure in FIG. 9 can be employed in the electronic apparatuses such as notebook type personal computer of which total height ranges from 25 to 40 mm. However, in the case of mobile computers requiring a further compact and slim body, the height of cooling fan 5, i.e. 2 ×(a+b+c) becomes a possible obstacle to meeting requirements.

where "a"=radius of motor, "b"=blade height, "c"=frame thickness

The height of an electronic apparatus that requires an extra slim body is often restricted by the height of cooling fan 5. In order to reduce the height of fan 5, each dimension mentioned above, i.e. "a", "b" and "c" should be reduced; however, the following inconveniences accompany this reduction:

Reduction of dimension "a": decreasing the motor power and lowering the motor efficiency;

Reduction of dimension "b": decreasing the air volume; and

Reduction of dimension "c": degrading the strength of the frame; and weakening the heat sink function, The height of cooling fan 5 is thus cannot readily lowered, which has been an obstacle to further downsizing of compact electronic apparatuses such as mobile personal computers.

The structure shown in FIG. 10 has been proposed to overcome the problem of the structure shown in FIG. 9. However, in the case of compact electronic apparatuses such as a mobile personal computers this structure of FIG. 10 still has the following problem. Two sheets of double sided PWA accommodate the components. Assume that each PWA measures 50 mm×100mm Then the total components-mounting-area is thus 50 mm×100 mm×2 sides×2 sheets= 20000 $mm^2$.

In order to dispose a fan 8 that measures 40 mm×40 mm, one PWA 3 should be cut out, which reduces the components-mounting-area by 40 1mm×40 mm×2 sides= 3200 $mm^2$. As a result, the total components-mounting-area is reduced by 16%.

This area-reduction decreases the number of components which can be mounted, and has been an obstacle to realizing compact size electronic apparatus having high performance and versatile functions.

SUMMARY OF THE INVENTION

The present invention addresses the problems above and aims to provide a compact and high performance cooling-device for electronic apparatuses requiring a cooling fan and a fan motor whereby the apparatuses can be thin in size and for which a reduction of the component-mounting-area can be minimized.

An arrangement according to the present invention utilizes:

(a) PWAs including heat-generating electronic components such as semiconductors, and being disposed in a housing of a thin-type electronic apparatus, such as a mobile personal computer or a digital video camera, so that a given space is provided between the housing and the PWAs;

(b) a cooling fan motor having a small and tubular case made of heat-conductive materials such as copper, aluminum and the like, the cooling fan motor having a height smaller than the height of the housing, and being disposed in the given space provided in the housing; and (c) an air discharge opening through which the heated air in the housing is discharged.

This structure described above allows the cooling fan motor to reduce its occupying space in the housing. The cooling fan thus can be placed to function efficiently. The build-up heat in the housing can be satisfactorily dissipated, which permits the interior components to be sufficiently cooled down. As a result, the structure according to the present invention can allows the electronic apparatuses such as mobile personal computers and digital video computers to be slimmed down without degrading cooling efficiency or decreasing the components-mounting-area.

DESCRIPTION OF THE PREFERRED EMBODIMENTS

Exemplary embodiments of the present invention are described below with reference to the accompanying drawings.

Exemplary Embodiment 1

FIG. 1 to FIG. 4 show structures of an electronic apparatus having a cooling fan and a cooling fan motor. When there are the same elements as used in the prior art, the same symbols are used.

Figure 1:
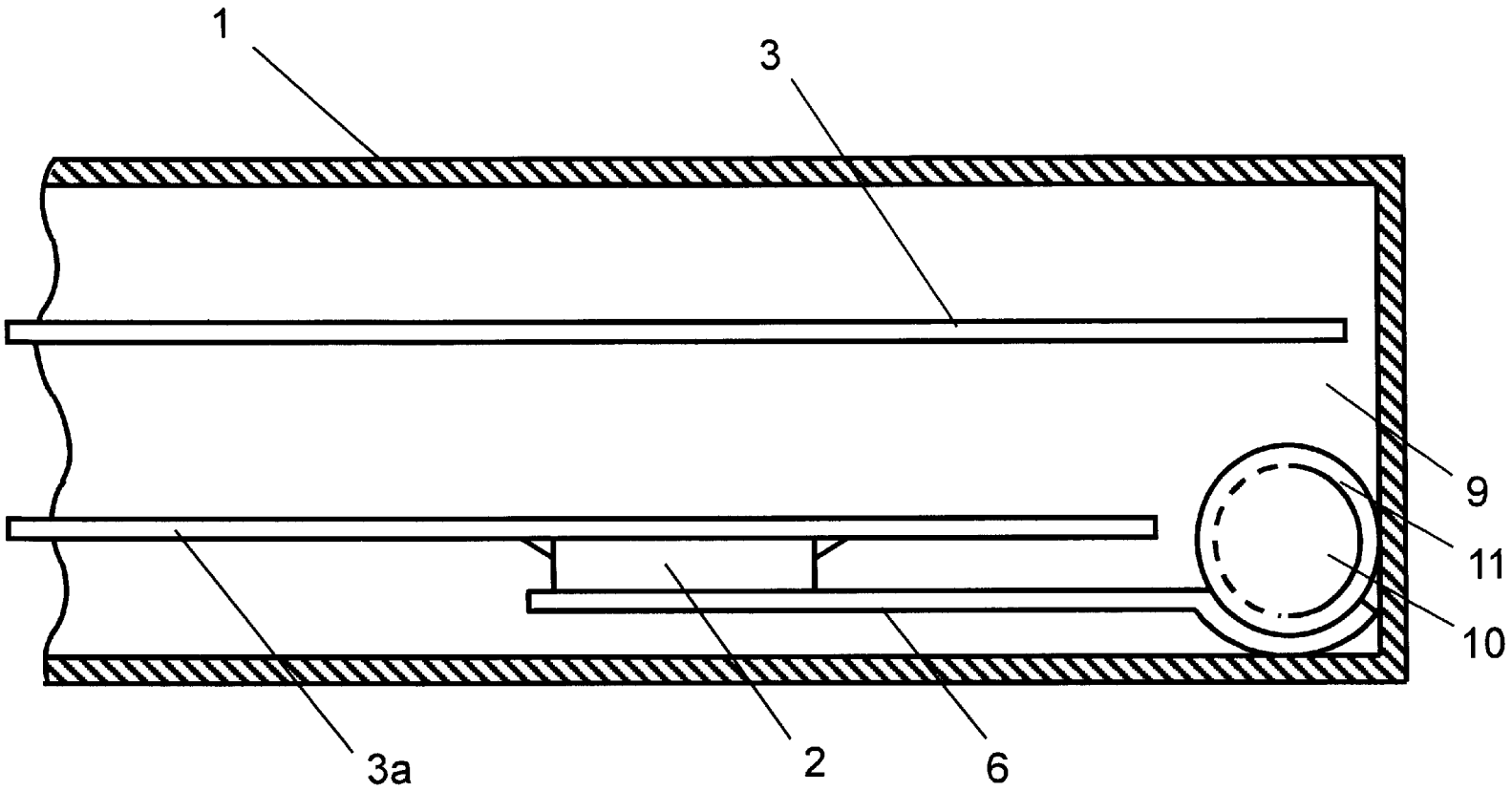
FIG. 1 is a cross section of an electronic apparatus having a cooling fan in accordance with a first exemplary embodiment of the present invention.
Figure 2:
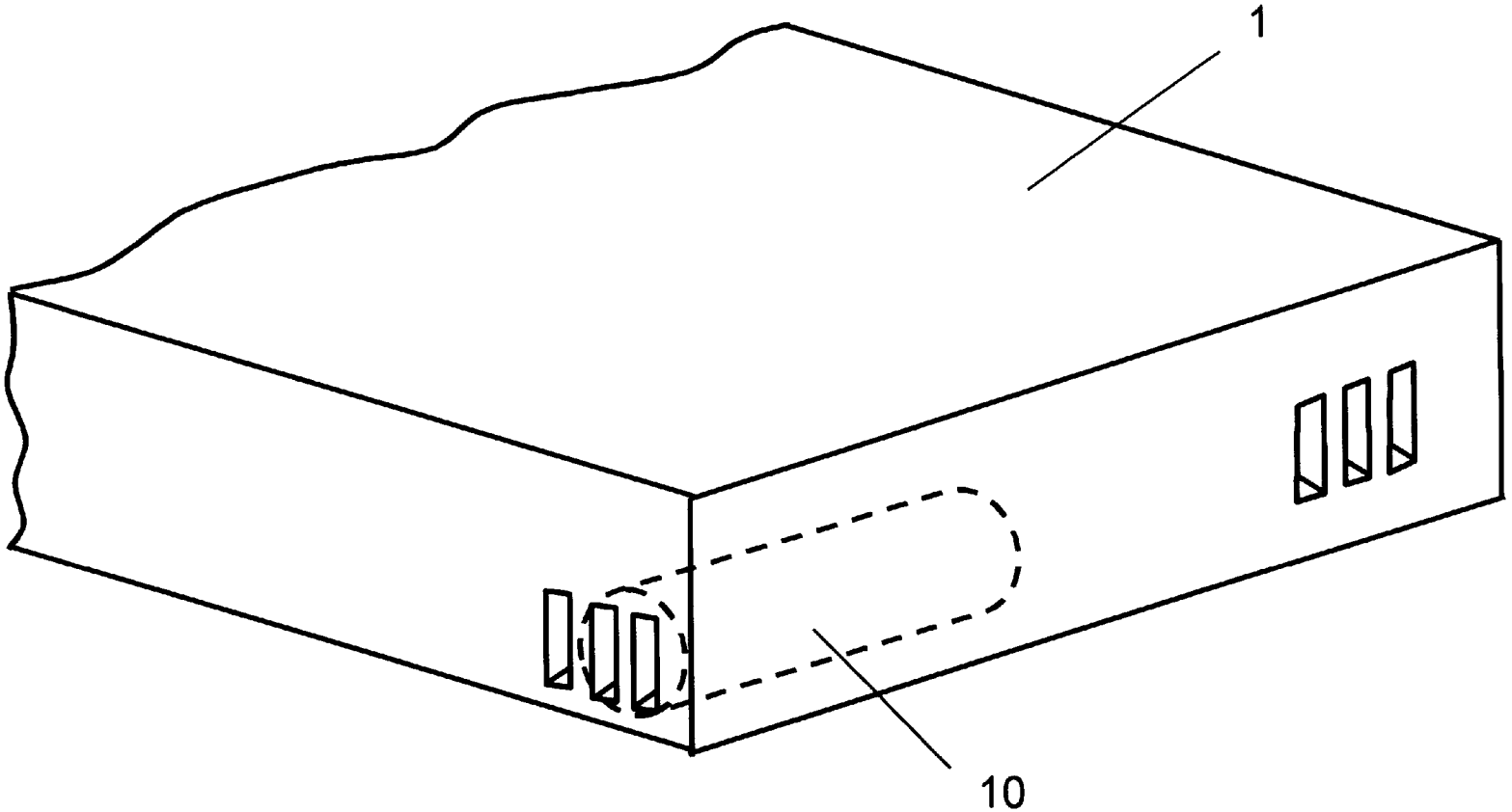
FIG. 2 is a perspective view depicting a slim housing of the electronic apparatus used in the first exemplary embodiment of the present invention.

In these drawings, a plurality of PWAs 3 and 3*a* are mounted in a slim housing 1 in a multistory manner. The PWAs accommodate electronic components. Among the PWAs mounted in the multistory manner, PWA 3*a* mounted as the lowest story (nearest to the housing bottom) accommodates heat generating components such as semiconductors. PWA 3 *a* has a little shorter length than others. Small space 9 for accommodating a cooling fan is provided between a face plate of housing 1 and one edge of PWA 3*a*. Cooling fan motor 10 is placed so that its height is less than the height of housing 1. Air discharge openings are provided in housing 1 as shown in FIG. 2.

Figure 3:
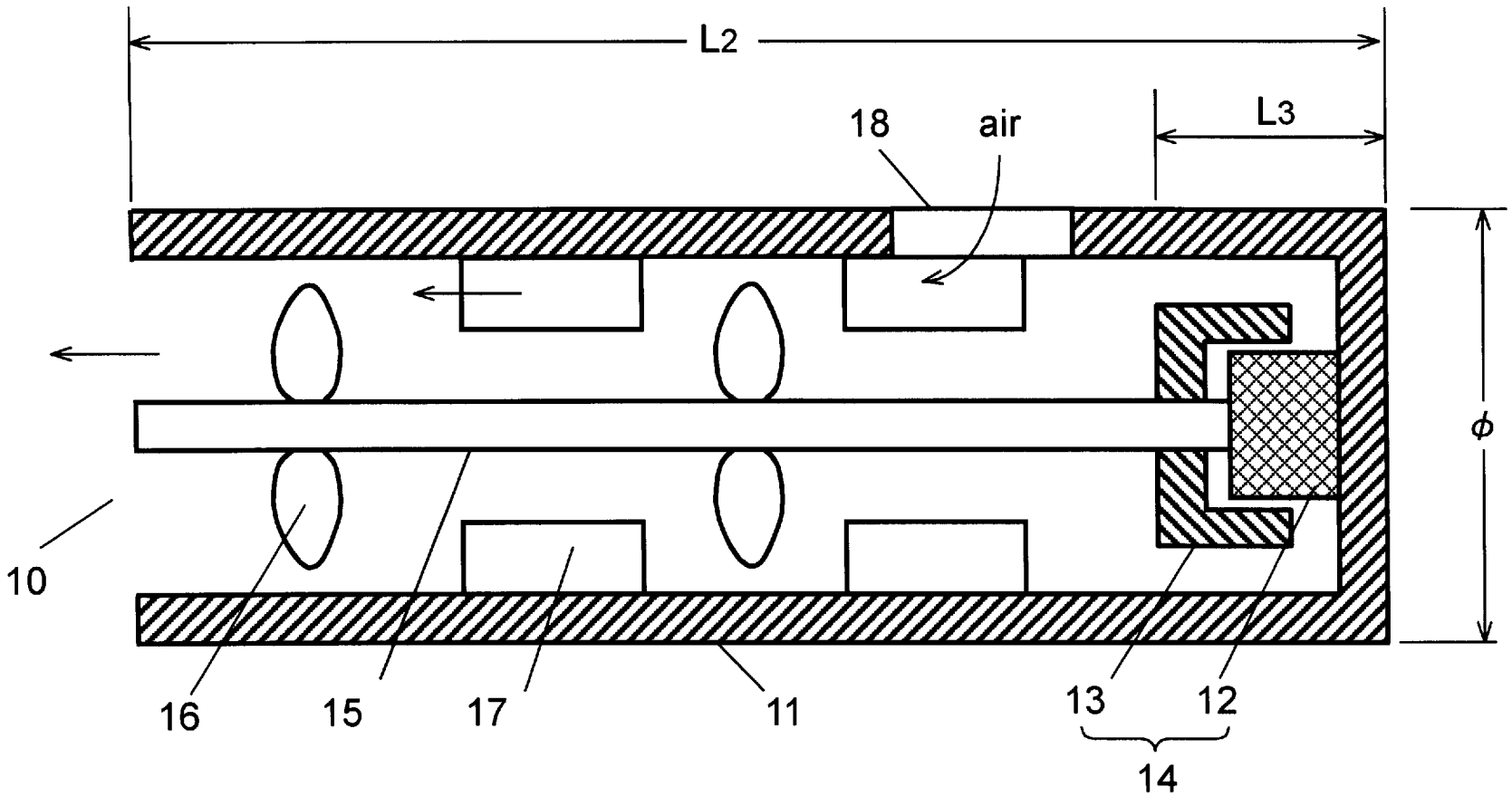
FIG. 3 is an elevational cross section of a cooling fan motor to be disposed in the electronic apparatus used in the first exemplary embodiment of the present invention.
Figure 4:
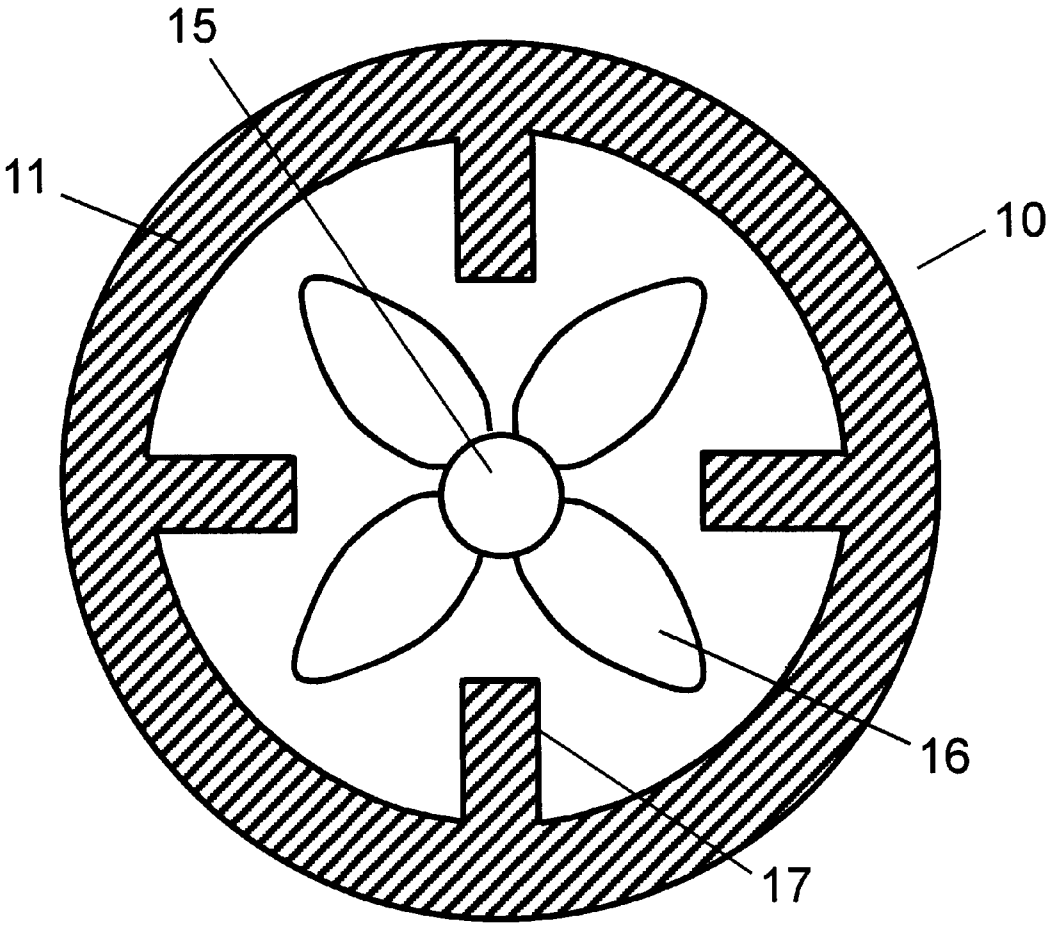
FIG. 4 is a cross section of the cooling fan to be disposed in the electronic apparatus used in the first exemplary embodiment of the present invention.

As shown in FIG. 3, the cooling fan motor comprises:

(a) a tubular case 11, having a small diameter and made of a heat-conductive material such as copper or aluminum, for functioning as a heat exchanger that transfers and dissipates heat;

(b) a motor section 14 provided on a first end of case 11, and comprising stator 12 and rotor 13; and (c) a rotary shaft 15 coupled to rotor 13 and rotatably supported by stator 12.

Shaft 15 extends to a second end of case 11, and is disposed at the center of both ends of case 11. The second end of case 11 is open. Shaft 15 has a plurality of blades 16 intervals of a given distance. Fins 17 are placed at given locations between blade 16 and motor section 14 as well as between respective blades, and protrude into the case. Fins 17 are shaped into plates or poles and placed approximately at the same intervals as that of the blades 16. On the side of case 11, an air intake opening 18 is provided. Rotary shaft 15, blades 16 and some part of rotor 13 can be molded in a monoblock with synthetic resin.

Motor section 14 can be placed outside an end 1 of case 11 instead of inside of the end. Air intake opening 18 can be placed at the end where motor section 14 is mounted. The shape of fins 17 can be a cylinder, a triangle pole, a pin or other shape which can dissipate heat.

Cooling fan motor 10 is placed in space 9 in such a manner that the height of motor 10 is lower than the height of the housing. To be more specific, a longitudinal direction of shaft 15 parallel with one side of PWA 3*a*. Heat conductive member 6 made of an aluminum plate, copper plate or graphite is coupled to heat generating components 2 such as semiconductors. The side face of case 11 is wrapped with a curved end of heat conductive member 6 and both of the elements are thermally coupled.

The end part of heat conductive member 6 can be coupled to case 11 by adhesive, welding, or crimping. Member 6 and case 11 can be in a monoblock. Depending on the placement of mounted components and a relation between PWAs 3, space 9 can be tilted with regard to an edge of the PWA 3*a* and not necessarily placed at the end of the housing 1.

An operation of, the cooling fan is described hereinafter. The heat generated by components 2 on PWA 3*a* travels to case 11 of cooling fan motor 10 via heat conductive member 6. Driving cooling fan motor 10 draws air through air intake opening 18 into housing 1. The wind produced by blades 16 hit each fin 17 in case 11. Heat is exchanged from case 11 and fins 17, both having the conducted heat, and the wind produced by blades 16. The heated air is discharged outside housing 1 through the air discharge opening. This operation cools down components 2 on PWA 3*a*, and produces air-flow in housing 1 thereby preventing the housing temperature from rising.

A dimension of cooling fan motor 10 is described hereinafter. In FIG. 3, case 11 measures as follows: diameter $\phi$=15 mm, length L2=20 mm, length of motor section 14, L3=7 mm. The diameter $\phi$ is substantially equal to dimension 2*a* of conventional cooling fan motor 5 shown in FIG. 9. The diameter $\phi$ is expressed as (2*a*+1) mm inclusive of the thickness of the case per se.

Figure 9B:
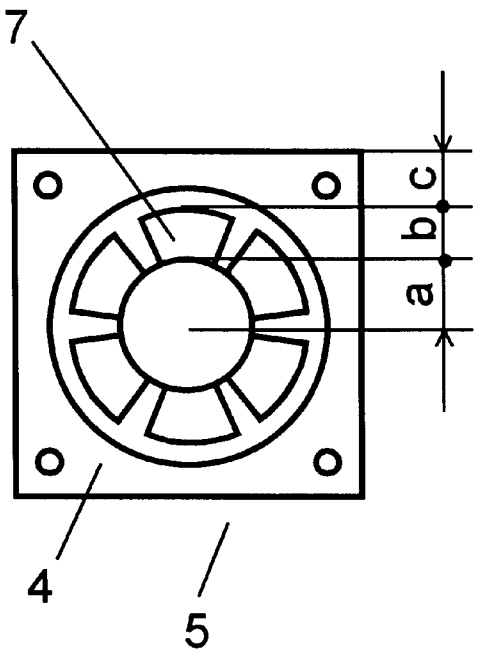
FIG. 9B PRIOR ART
FIG. 9A and FIG. 9B are cross sections of an essential part of a conventional electronic apparatus having a cooling fan.
Figure 9A:
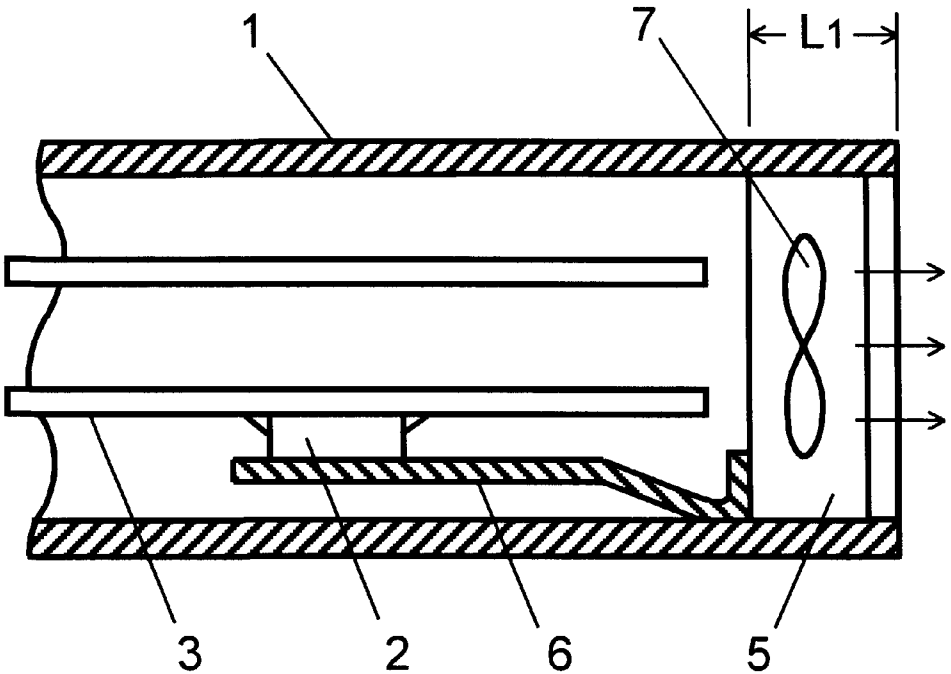
FIG. 9A PRIOR ART
Figure 10:
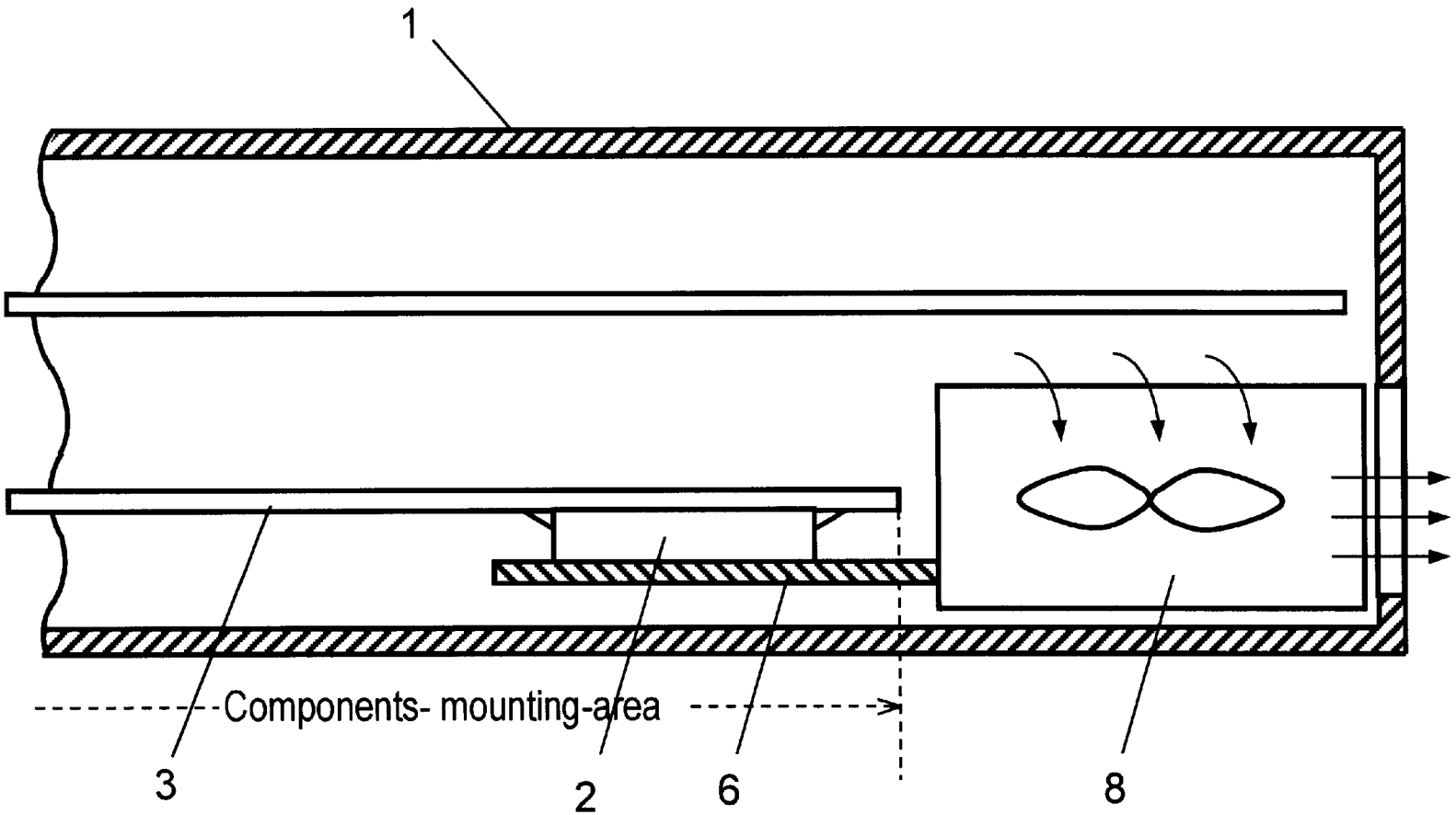
FIG. 10 PRIOR ART
FIG. 10 is a cross section of an essential part of another conventional electronic apparatus having a cooling fan.

Assume that conventional housing 1 shown in FIG. 9A has a height of e.g. ca. 25 mm and cooling fan 5 has a height of 25 mm.

TABLE 1

| Prior art shown in Fig. 9 | Present invention |
|---|---|
| Height of cooling fan 5 | Diameter ϕ of cooling fan motor 10 inclusive case 11 per se |
| 2(a + b + c) > | 2a + 1 |
| 25 mm > | 15 mm |

As such, cooling fan motor 10 of the present invention is lower than conventional cooling fan 5 by ca. 10 mm. Motor 10 can be therefore mounted in the electronic apparatuses having thinner housings. PWA 3 mounted at the upper store can avoid being shortened so that the components-mounting-area can avoid a substantial reduction.

Cooling fan motor 10 of the present invention reduces its occupying space substantially, thereby slimming and downsizing electronic apparatuses.

Assume that the dimensions of conventional cooling fan 5 and fan motor 10 of the present invention are as follows:

L1 of fan 5=10 mm, L2 of motor 10=20 mm.

Then both volumes are expressed as shown in Table 2.

TABLE 2

| Volume of conventional fan 5 | Volume of fan motor 10 inclusive case 11 |
|---|---|
| $\{2(a + b + c)\}^2 \times L1$ > | $\pi \times \}(2a + 1)/2\}^2 \times L2$ |
| $25^2 \times 10 = 6250\ mm^3$ > | $\pi \times 15^2/4 \times 20 = 3533\ mm^3$ |

This comparison tells that fan motor 10 of the present invention only occupies 57% of the area occupied conventional fan 5. As a result, fan motor 10 can be employed in the slimmer housing of downsized apparatuses.

According to the first exemplary embodiment, rotary shaft 15 of motor section 14 is extended from rotor 13, and blades 16 are provided on shaft 15, thereby reducing the diameter of motor 10. A plurality of blades 16 can be provided on extended shaft 15, thereby increasing air volume. As a result, the space occupied by motor 10 can be smaller than that by the prior art, and the heat produced by components 2 travels sufficiently to case 11 and fins 17 via heat conductive member 6. Then the cooling fan dissipates the heat and cools down the house interior. The rotational part of the cooling fan is not exposed so that motor 10 can be incorporated in the housing with ease.

In this exemplary embodiment, heat conductive member 6 is handled as a discrete element; however, it may be formed by an extended part of tubular case 11 of motor 10. Tubular case 11 may have a flat part on its side.

Exemplary Embodiment 2

Figure 5:
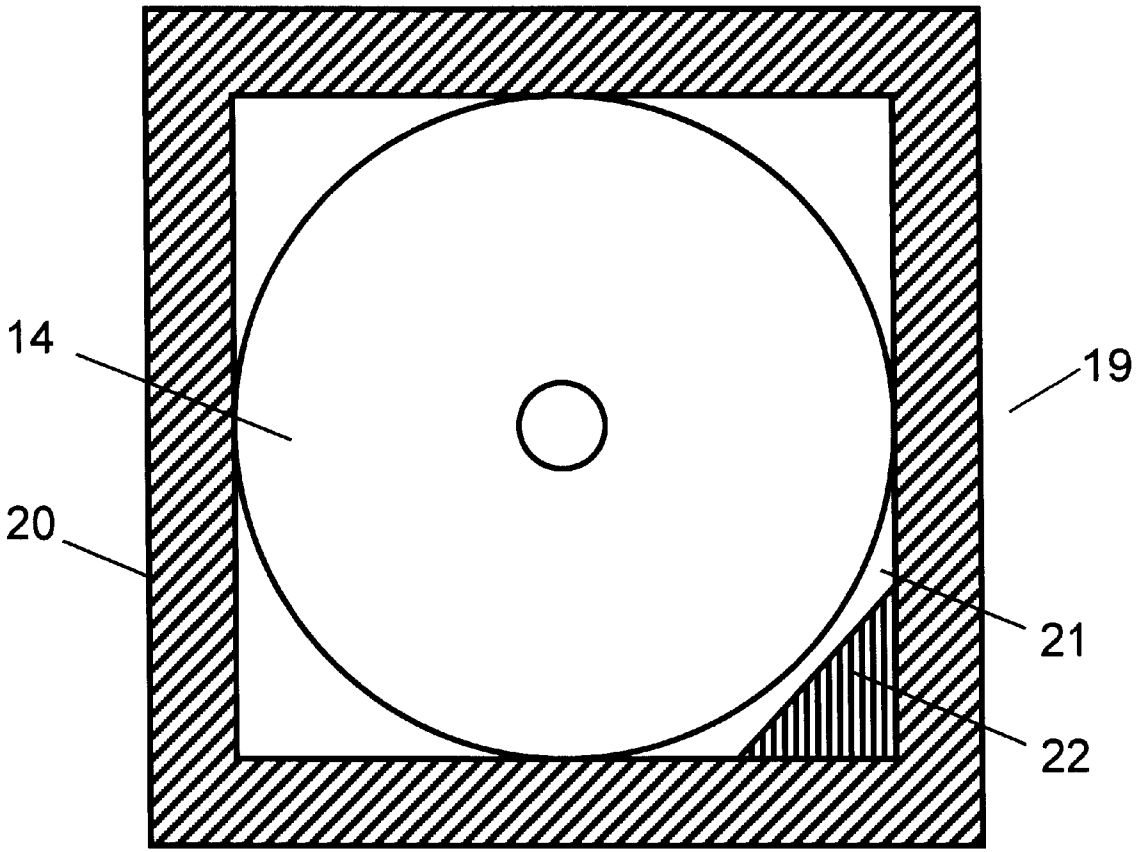
FIG. 5 is a cross section of a cooling fan in accordance with a second exemplary embodiment of the present invention.

A cooling fan motor 19 shown in FIG. 5 has advantages due in a fan case and structure therein. A case 20 is shaped in a rectangular tube of which plan cross section of the case shows a rectangle. Motor section 14, blades 16 and fins 17 are provided in the case, which is the same arrangement as the first exemplary embodiment depicted in FIG. 3. Further, a motor driving circuit 22 is disposed in a space 21 in a corner of case 20 in which motor section 14 is mounted.

This structure of cooling fan motor 19 increases an area for heat-exchange thanks to the shape of the rectangular tube case 20, and the cooling efficiency is thus improved. Motor driving circuit 22 this needs not to be mounted outside of motor 19, e.g. on the PWA, which spares the space supposed to be occupied by circuit 22 in the housing. As a result, electronic apparatuses can be further slimmed down. Rectangular tube case 20 can be fit in a corner of housing 1 so that case 20 can be fixed to housing 1 in a more stable manner.

Exemplary Embodiment 3

Figure 6:
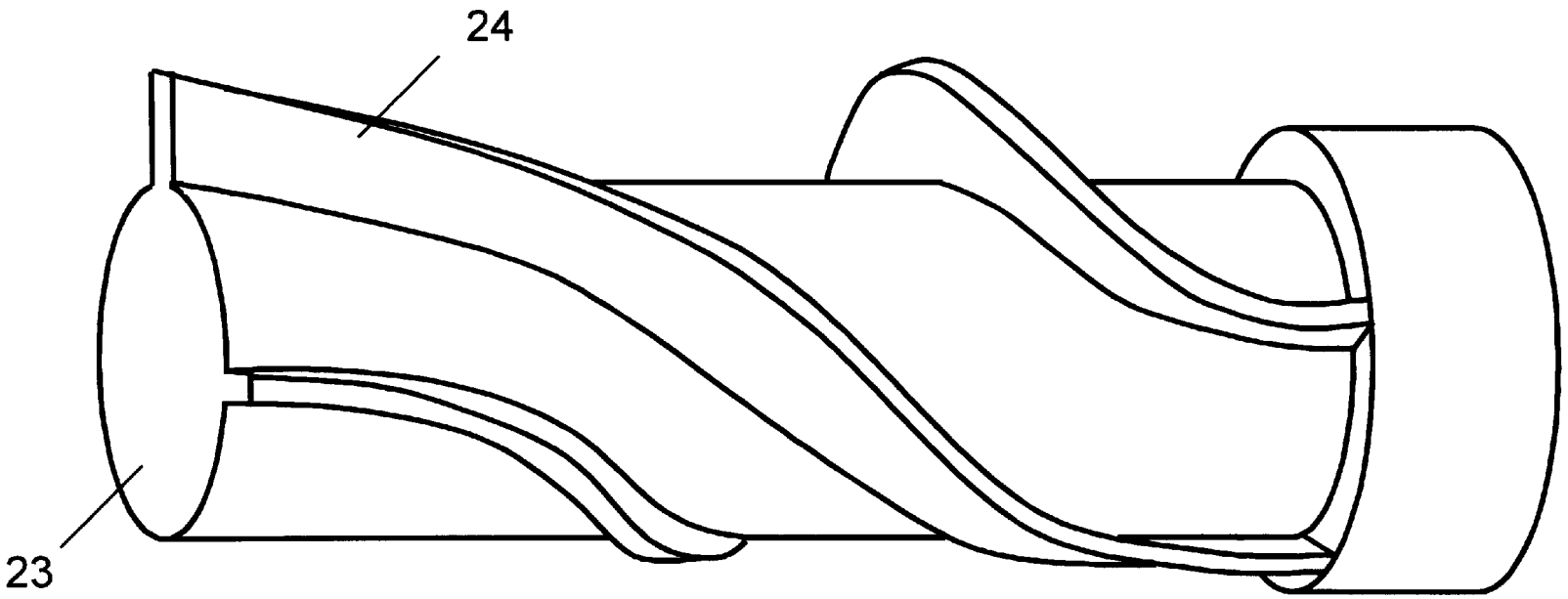
FIG. 6 is a perspective view of blades in accordance with a third exemplary embodiment of the present invention.

The blades of a cooling fan motor in accordance with the third exemplary embodiment depicted in FIG. 6 has an advantage due to its structure. Spirally shaped blades 24 are continuously formed on a rotary shaft 23 in the longitudinal direction. In this exemplary embodiment, shaft 23 formed by an extended portion of some part of the rotor and spiral blades 24 are molded into a monobody with synthetic resin.

This structure increases an active area of the blades substantially, and provides for an easy assembly because the blades are incorporated into the rotary shaft. The heat conducted to the case is dissipated efficiently by the wind produced by spiral blades 24, whereby the case is cooled down sufficiently.

Exemplary Embodiment 4

Figure 7:
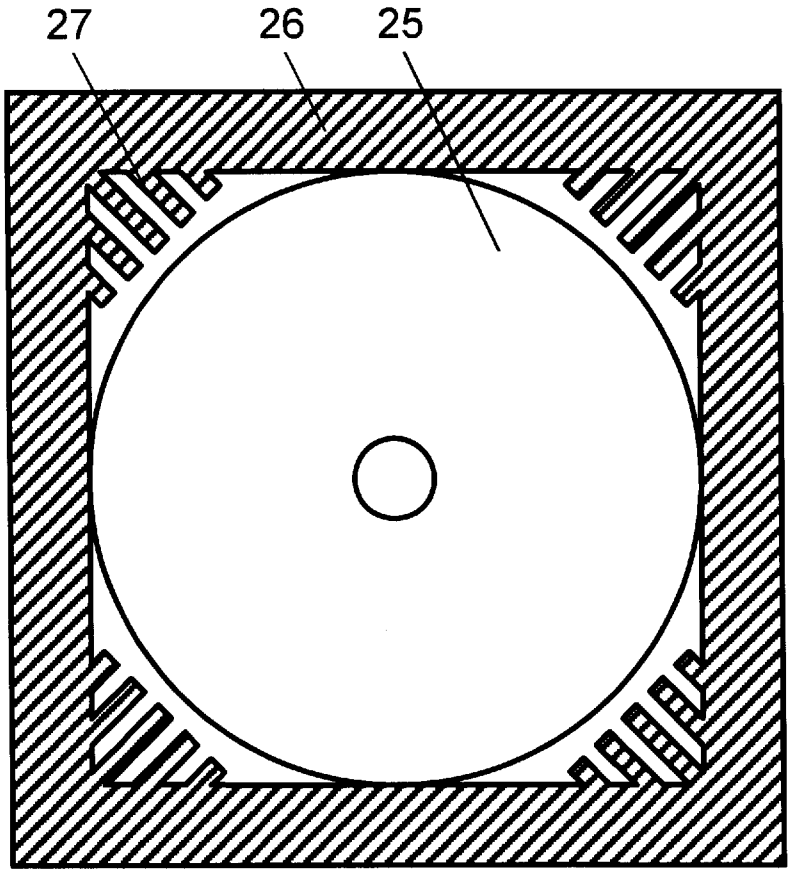
FIG. 7 is a cross section of a cooling fan in accordance with a fourth exemplary embodiment of the present invention.
Figure 8:
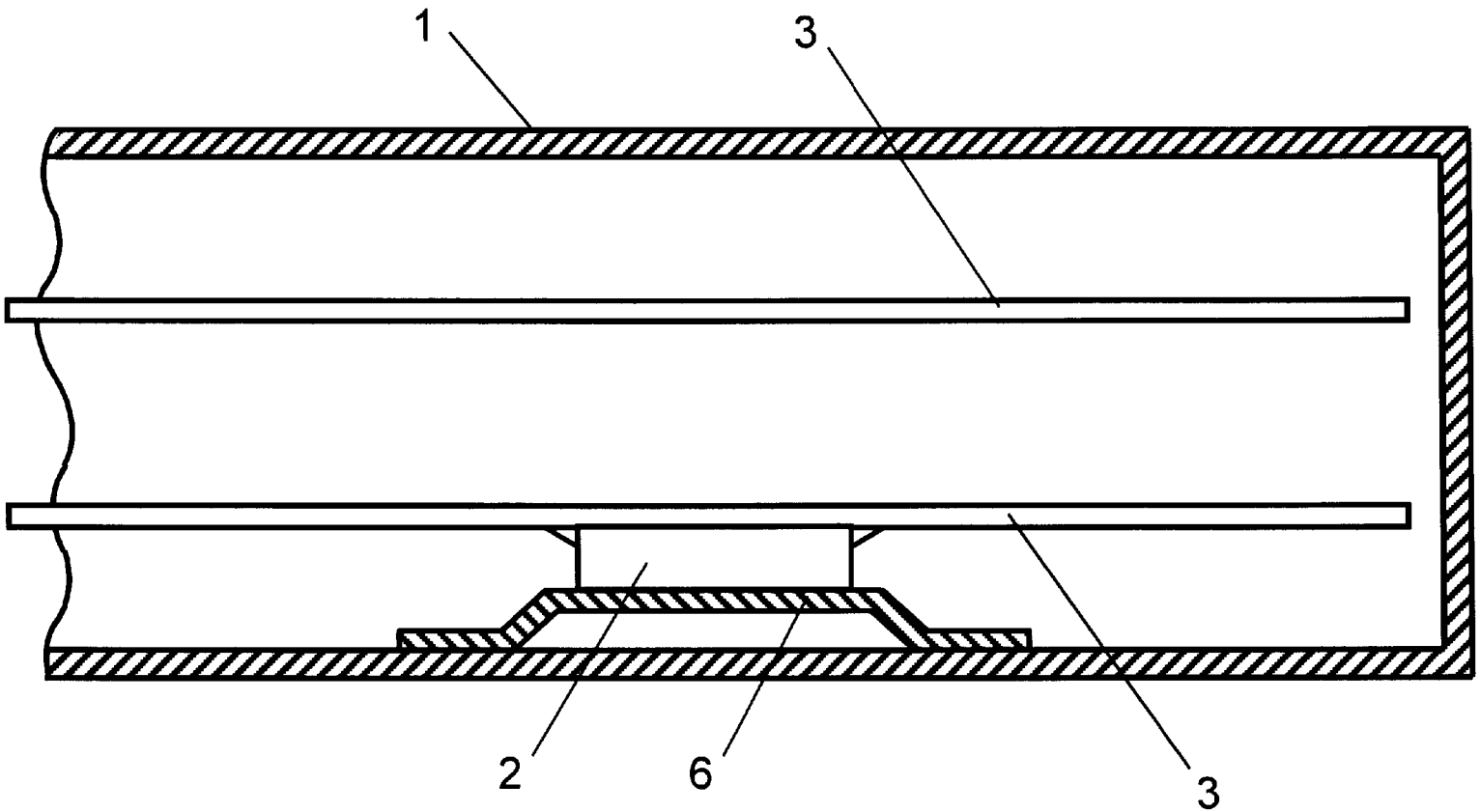
FIG. 8 PRIOR ART
FIG. 8 is a cross section of an essential part of a conventional electronic apparatus.

A cooling fan motor 25 in the fourth exemplary embodiment shown in FIG. 7 has a case 26 that is shaped in a rectangular tube. A plan cross section of case 26 shows a rectangle. Fins 27 are provided on the corners of case 26 and protrude inward thereof.

A cooling fan having spiral blades 24 that are described in the third exemplary embodiment can be incorporated into case 26. Spiral blades 24 can dissipate the heat effectively and cool down case 26 sufficiently with wind via fins 27. Case 26 having fins 27 can be combined with blades 16 and fins 17 discussed in the first exemplary embodiment that is depicted in FIG. 3.

As discussed above, the present invention can effectively dissipate the interior built-up heat produced by the heat-generating components and cool down the housing with the cooling fan motor. The cooling fan motor comprises a motor section and a fan, and is placed at the end of the small tubular case that occupies less space in the housing than a conventional case. The cooling fan motor can thus contribute to realizing smaller and slimmer electronic apparatuses such as mobile computers, digital video cameras and the like, which may produce great merit in industrial applications.

What is claimed is:

1. A cooling fan motor comprising:

a motor section having a rotary shaft;

a heat conductive case in which the rotary shaft is disposed, said motor section being disposed at a first end of said case;

a blade mounted on the rotary shaft;

wherein said case comprises a tube with a rectangular cross section; and wherein a motor driving circuit is disposed at a corner within said case.

2. The cooling fan motor of claim 1 wherein said heat conductive case includes at least two openings.

3. The cooling fan motor of claim 1 wherein said heat conductive case includes at least two openings, and a fin protrudes inward of said case.

4. The cooling fan motor of claim 1 wherein a plurality of blades are provided along a longitudinal direction of the rotary shaft at predetermined intervals.

5. The cooling fan motor of claim 2 wherein a plurality of blades are provided along a longitudinal direction of the rotary shaft at predetermined intervals.

6. The cooling fan motor of claim 3 wherein a plurality of blades are provided along a longitudinal direction of the rotary shaft at predetermined intervals.

7. The cooling fan motor of claim 3 wherein a plurality of fins are provided along a longitudinal direction of the rotary shaft at predetermined intervals.

8. A cooling fan motor comprising:

a motor section having a rotary shaft;

a heat conductive tubular case having a rectangular cross section, said motor section being disposed at a first end of said case;

an opening disposed at a second end of said case and another opening disposed at a place different from the first and the second ends;

wherein a motor driving circuit is disposed at a corner within said case;

wherein said rotary shaft is mounted at a center of the opening at the second end of said case;

wherein a plurality of blades are mounted along a longitudinal direction of the shaft at predetermined intervals; and wherein a plurality of fins protrude inward of said case at intervals approximately equal to the predetermined intervals at which said blades are mounted.

9. The cooling fan motor of claim 1 wherein said blade is formed in a spiral on the rotary shaft.

10. The cooling fan motor of claim 8 wherein each of said blades is formed in a spiral on the rotary shaft.

11. The cooling fan motor of claim 1 wherein said motor is mounted in an electronic apparatus and a case of said motor is coupled with a heat-generating section in a housing of the apparatus.

* * * * *